US010618146B2

(12) United States Patent
Huang

(10) Patent No.: US 10,618,146 B2
(45) Date of Patent: Apr. 14, 2020

(54) WRENCH

(71) Applicant: Cheng-Cheng Huang, New Taipei (TW)

(72) Inventor: Cheng-Cheng Huang, New Taipei (TW)

( * ) Notice: Subject to any disclaimer, the term of this patent is extended or adjusted under 35 U.S.C. 154(b) by 167 days.

(21) Appl. No.: 15/970,880

(22) Filed: May 4, 2018

(65) Prior Publication Data

US 2019/0337127 A1 Nov. 7, 2019

(51) Int. Cl.
*B25B 13/46* (2006.01)

(52) U.S. Cl.
CPC ..... *B25B 13/463* (2013.01)

(58) Field of Classification Search
CPC ..... B25B 13/462; B25B 13/463
See application file for complete search history.

(56) References Cited

U.S. PATENT DOCUMENTS 9,815,179 B2 * 11/2017 Anderson ..... B25B 13/463
10,232,494 B2 * 3/2019 Yang ..... B25B 13/463
10,272,549 B2 * 4/2019 Oliver Lagardera .... B25G 1/06
2010/0132517 A1 * 6/2010 Crawford ..... B25B 13/461 81/63
2014/0208897 A1 * 7/2014 Kao ..... B25B 13/463 81/63
2018/0036869 A1 * 2/2018 Kao ..... B25B 13/463
2018/0117742 A1 * 5/2018 Chou ..... B25B 13/463

* cited by examiner

*Primary Examiner* — David B. Thomas

(57) ABSTRACT

A wrench has a wrench body, a control member, a braking toothed member and a ratchet wheel. The wrench body has a first and a second operating portions. The first operating portion has an assembling aperture and a control aperture, a control member having a handle and a shaft rod, the shaft rod provided with a stepped through hole and disposed in the control aperture; a braking toothed member disposed in the arcuate groove, an end of the braking toothed member has a toothed portion and a convex groove, the convex groove connected to a link shaft via a connecting pin, the link shaft jacketed by an elastic member and together disposed in the through hole. The ratchet wheel disposed in the assembling aperture, an annular toothed portion disposed on a periphery of the ratchet wheel and engaging with the toothed portion of the braking toothed member.

4 Claims, 6 Drawing Sheets

WRENCH

BACKGROUND OF INVENTION

1. Field of Invention

The present invention relates to a wrench, and more particularly to a reversing wrench.

2. Description of Related Art

A conventional reversing wretch, please refer to FIG. 9, a rotating member 60 is assembled at one end of a wretch 50, and the rotating member 60 can be rotated at the end of the wretch 50 to rotate a nut or bolt for locking and unlocking operation. A toothed ring 61 is arranged on the outer edge of the rotating member 60, a toothed ratchet wheel 70 correspondingly engages with one side of the toothed ring 61, and the ratchet wheel 70 can move in a first chamber 51 the inside of the wrench 50. Another side of the ratchet wheel 70 is provided with a curved surface 71, the wrench 50 further has a second chamber 52 communicates with the first chamber 51, and the second chamber 52 is provided with a control block 80. The control block 80 is provided with a socket 81, a spring 82 is installed at the socket 81, and an abutment sleeve 83 sleeves onto a top end of the spring 82 so that the abutment sleeve 83 is pushed against the arcuate surface 71 of the ratchet wheel 70 by the spring 82. The control block 80 controls the abutment sleeve 83 to place the ratchet wheel 70 on different sides of the first slot chamber 51 and a one-way drive strength can be generated.

The above-mentioned conventional structure have some deficiencies, and the main reasons are as follows: First, the spring 82 and the abutment sleeve 83 are sandwiched between the ratchet wheel 70 and the control block 80, and another end of the abutment sleeve 83 is pushed against the arcuate surface 71 of the ratchet wheel 70 by the spring 82. When the ratchet wheel 70 is moved by the wrench 50 or the control block 80 is switched, one end of the slip sleeve 83 slides on the arcuate face 71 of the ratchet wheel 70, and the other end rubs laterally on the insertion hole 81 of the control block 80, so that the sleeve 83 and the spring 82 are easily deformed or ejected from the socket 81, and form resistance to reduce its operating stability. Second, for the assembling procedure of the wrench 50, the control block 80 is firstly installed and secured into the second chamber 52 so that the control block 80 is restricted to only be able to perform rotation operation, then, the spring 82 is placed into the socket 81 from the chamber 51 and sleeves onto the abutment sleeve 83 is sleeved on the top of the spring 82. Since the opening of the first slot chamber 51 faces the rotating member 60, it will not be easy to mount the spring 82. Furthermore, the sizes of the spring 82 and the abutment sleeve 83 are relatively small which can easy to fall or lose during the assembly process, and it will further increase the assembly difficulty, making it difficult to assemble and excessive components. Third, the spring 82 and the abutment sleeve 83 are sandwiched between the ratchet wheel 70 and the control block 80, and another end of the abutment sleeve 83 is pushed against the arcuate surface 71 of the ratchet wheel 70 by the spring 82. When the ratchet wheel 70 is moved, the thrust sleeve 83 can push the spring 82 to retract so a the space for the ratchet wheel 70 is maintained between the ratchet wheel 70 and the control block 80, so the sleeve 83 and the spring 82 protrude beyond the insertion hole 81 and reduce the positioning effect of the sleeve 83 and the spring 82.

Therefore, it is desirable to provide a reversing wrench to mitigate and/or obviate the aforementioned problems.

SUMMARY OF INVENTION

An objective of present invention is to provide a reversing wrench, which is capable of improving the above-mention problems.

In order to achieve the above mentioned objective,

Other objects, advantages, and novel features of invention will become more apparent from the following detailed description when taken in conjunction with the accompanying drawings.

DETAILED DESCRIPTION OF PREFERRED EMBODIMENT

Figure 1:
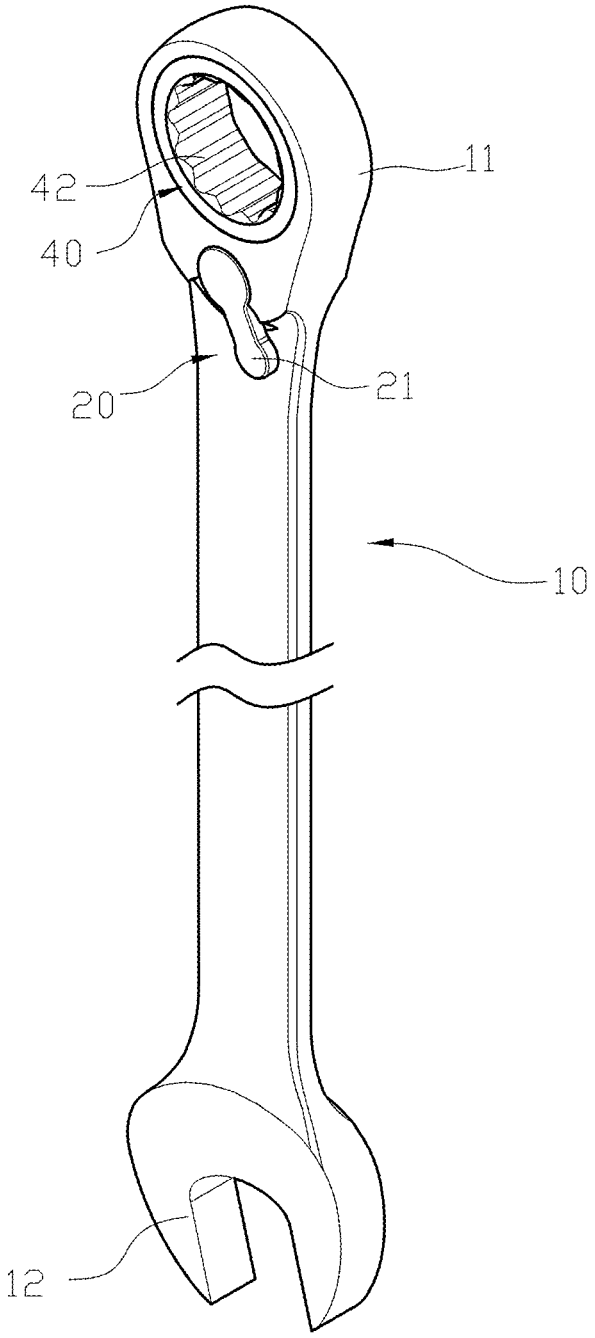
FIG. 1 is a perspective view of an embodiment according to the present invention.
Figure 2:
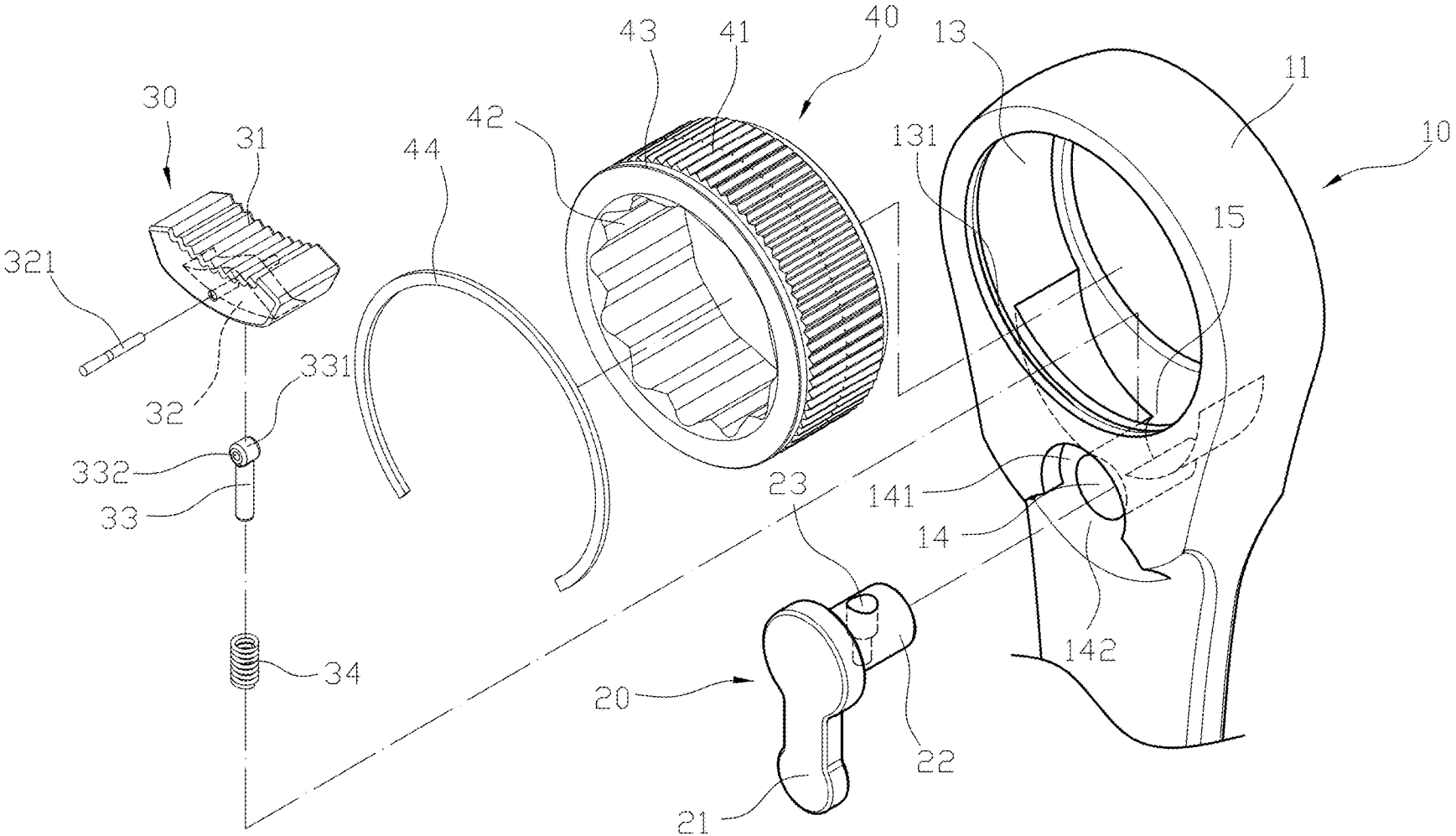
FIG. 2 is an exploded view of the embodiment according to the present invention.

First, please refer to FIGS. 1 and 2. A reversing wrench comprises: a wrench body 10, a control member 20, a braking toothed member 30 and a ratchet wheel 40. The wrench body 10 has a first operating portion 11 and a second operating portion 12. The first operating portion 11 has an assembling aperture 13 and a control aperture 14, and the assembling aperture 13 an the control aperture 14 are connected via an arcuate groove 15. The assembling aperture 13 further comprises a securing groove 131, the wrench body 10 further comprises a limiting groove 141 above the control aperture 14, and the limiting groove 141 has an opening 142. The control member 20 has a handle 21 and a shaft rod 22, the shaft rod 22 is provided with a stepped through hole 23 and disposed in the control aperture 14. The braking toothed member 30 is disposed in the arcuate groove 15, an end of the braking toothed member 30 facing the assembling aperture comprises a toothed portion 31 and another end facing the control aperture 14 forms a convex groove 32. The convex groove 32 is connected to a link shaft 33 via a connecting pin 321, and the link shaft 33 is jacketed by an elastic member 34 and together disposed in the through hole 23. The ratchet wheel 40 is disposed in the assembling aperture 13 of the first operating portion 11. An annular toothed portion 41 is disposed on a periphery of the ratchet wheel 40 and engages with the toothed portion 31 of the braking toothed member 30. The ratchet wheel 40 further comprises an operating hole 42 and a positioning groove 43, and the positioning groove 43 engages with a C-shaped retainer ring 44. The C-shaped retainer ring 44 is disposed in the securing groove 131 to position the ratchet wheel 40 in the assembling aperture 13.

Figure 3:
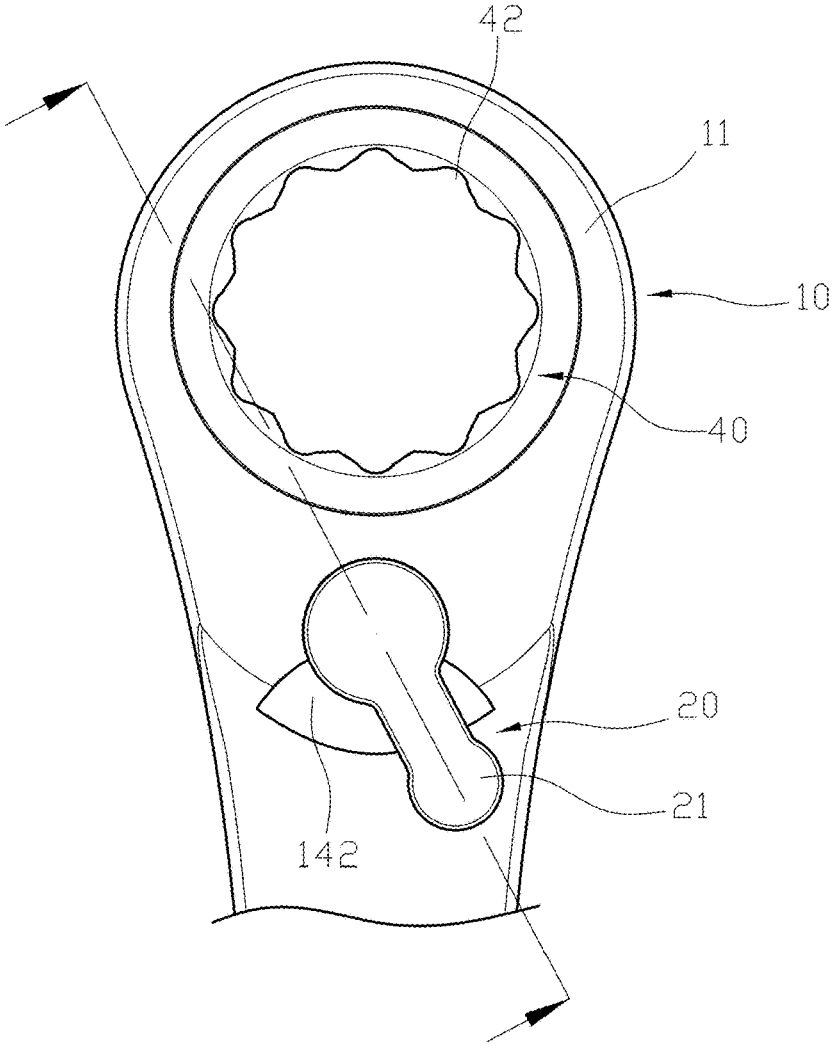
FIG. 3 is a plan view of the embodiment according to the present invention.
Figure 4:
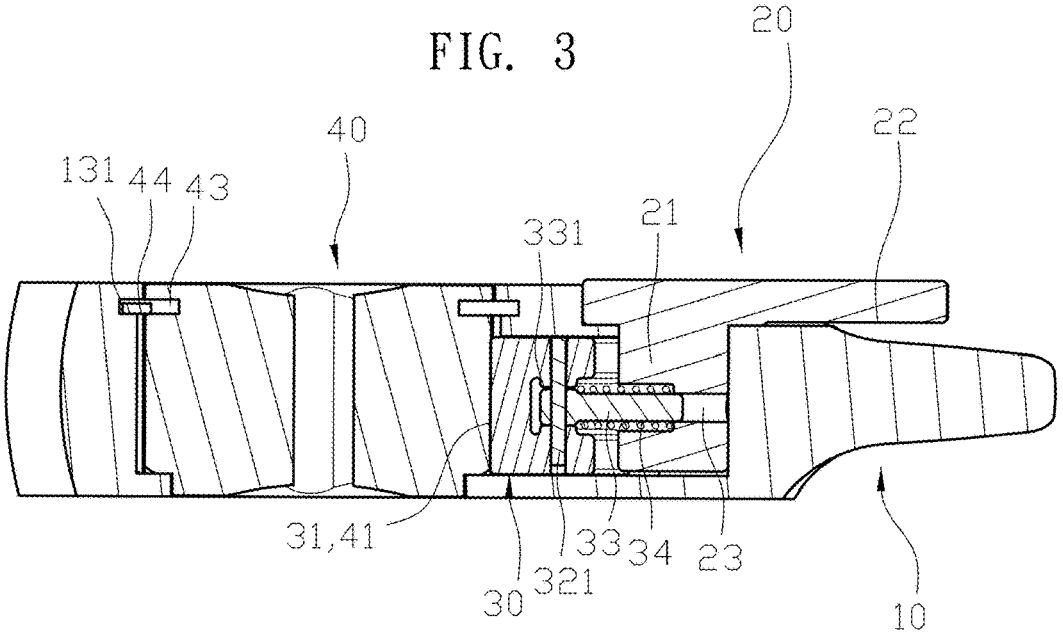
FIG. 4 is a sectional view of the embodiment according to the present invention.

For actual assembly, please refer to FIGS. 2, 3 and 4. The wrench body 10 employs the control aperture 14, the arcuate 15 and the assembling aperture 13 to accept the control member 20, the braking toothed member 30 and the ratchet wheel 40. The control member 20 utilizes the shaft rod 22 to enter into the control aperture and the handle 21 is positioned in the limiting groove 141 and passes through the opening 142. The convex groove 32 of the braking toothed member 30 employs a connecting pin 321 to connect to a link shaft 33, and the link shaft 33 is jacketed with an elastic member 34, and the link shaft 33 faces the control aperture 14 to make the braking toothed member 30 to pass through the assembling aperture 13 to enter into the arcuate 15. Meanwhile, the link shaft 33 and the elastic member 34 together pass through the control member 20 disposed in the through hole 23 of the shaft rod 22, and the elastic member 34 allows the link shaft 33 to be retractable. The toothed portion 31 faces the assembling aperture 13, the ratchet wheel 40 is mounted in the assembling aperture 13, the C-shaped retainer ring 44 engages between the positioning groove 43 and the securing groove 131, such that the ratchet wheel 40 is limited in the assembling aperture 13.

Figure 6:
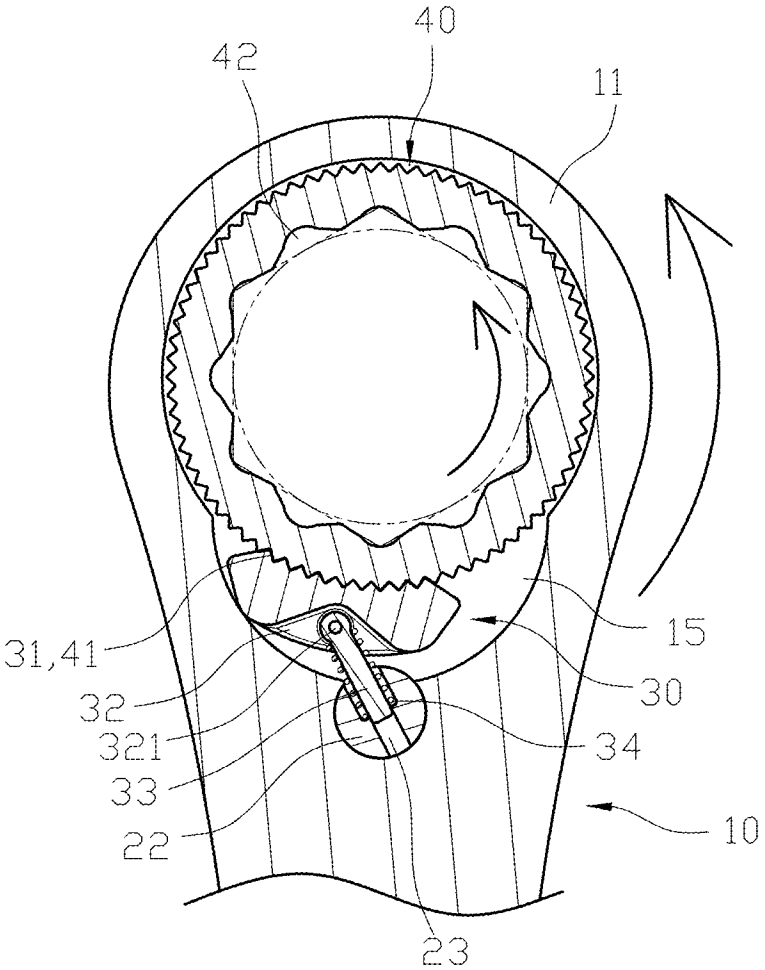
FIG. 6 is a schematic drawing showing the ratchet wheel rotating counterclockwise according to the present invention.
Figure 5:
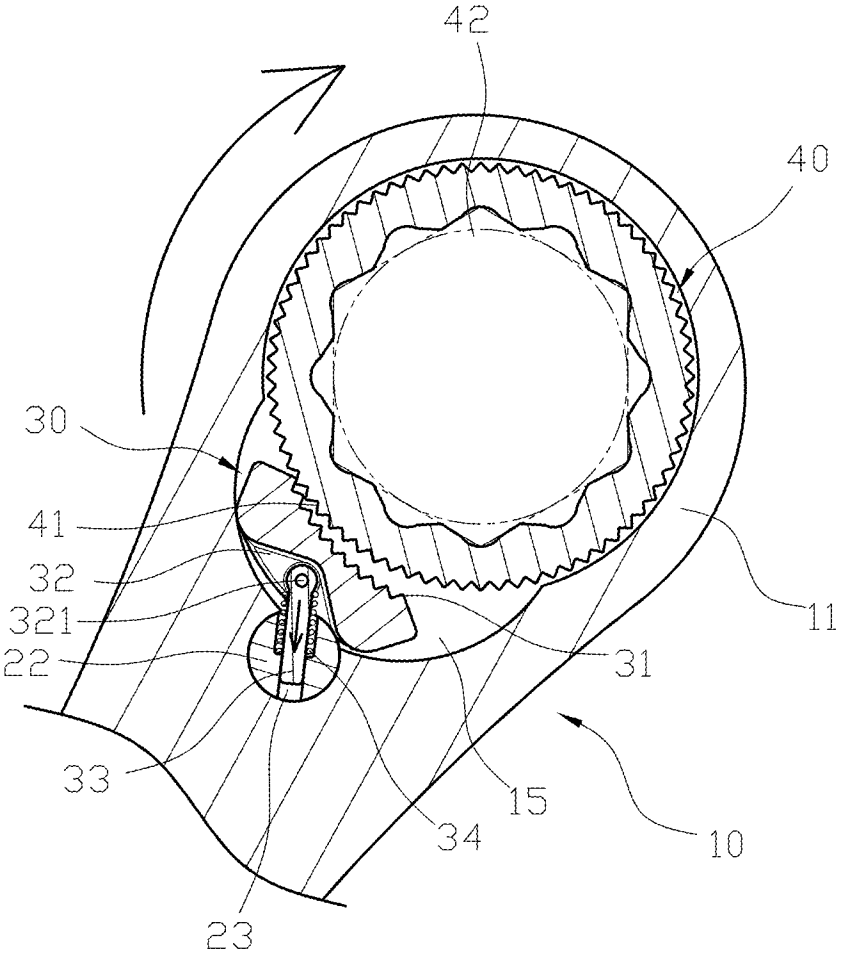
FIG. 5 is a schematic drawing showing the clockwise rotation according to the present invention.

For the actual use of the above-structure, please refer to FIGS. 5 and 6, the wrench body 10 utilizes the operating hole 42 of the ratchet wheel 40 to engage with a screw locking unit to achieve locking or loosening rotation movements. First, the acting direction of the braking toothed member 30 and the ratchet wheel 40 is controlled by the control member 20. When the braking toothed member 30 is pushed to be against to the arcuate groove 15 by the control member 20 in the clockwise direction, the braking toothed member 30 is also pushed clockwise by the link shaft 33 and the elastic member 34. When the wrench body 10 rotates clockwise, the direction of movement of the wrench body 10 is the same as the pushing direction of the elastic member 34, so that the ratchet wheel 40 can push the braking toothed member 30 back along the elastic member 34, Therefore, the toothed portion 31 of the braking toothed member 30 cannot engage with the annular toothed portion 41 of the ratchet wheel 40 and creates an idle state. Reversely, when the wrench body 10 is rotated counterclockwise, as shown in FIG. 6, the link shaft 33 of the braking toothed member 30 is pushed by the elastic member 34 in a direction opposite than the action direction of the wrench body 10, the braking toothed member 30 cannot be pushed back, so the toothed portion 31 engages with the annular toothed portion 41 of the ratchet wheel 40, thereby causing the ratchet wheel 40 to rotate and achieve the twisting action of the screw-locking unit, which causes the wrench body 10 to rotate counterclockwise.

Figure 8:
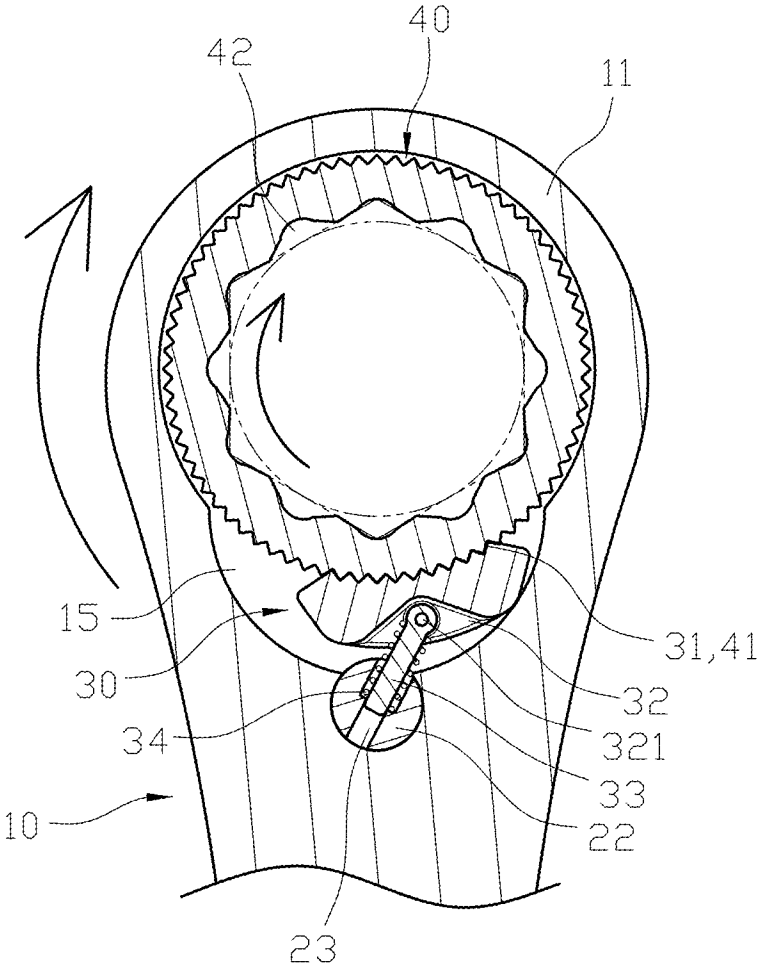
FIG. 8 is a schematic drawing showing the interlocking ratchet member in the clockwise rotation according to the present invention.
Figure 7:
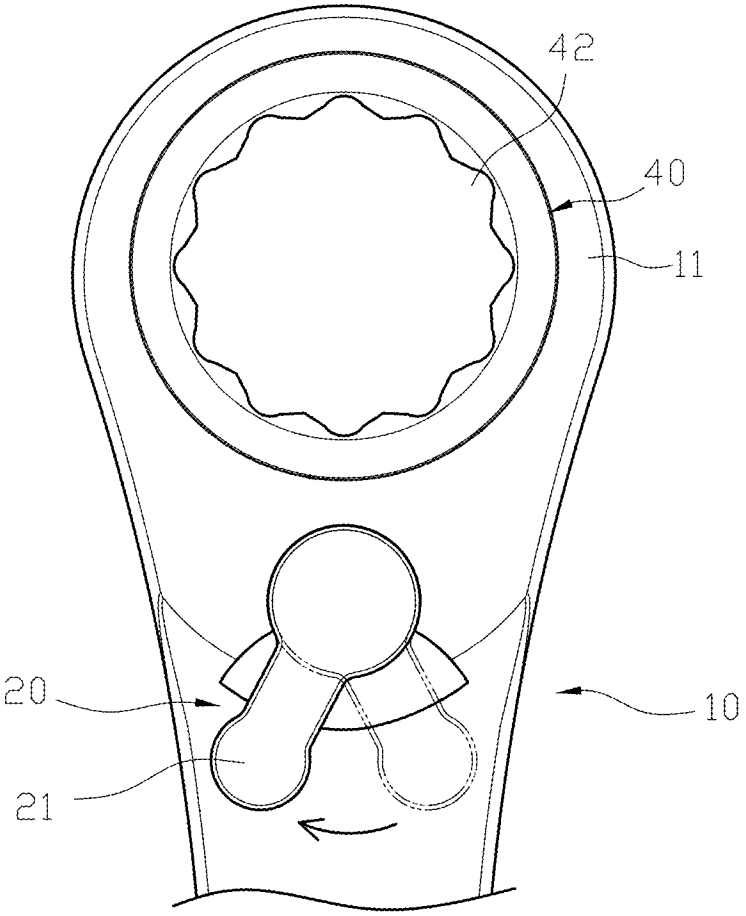
FIG. 7 is a schematic drawing showing adjustment of the control member according to the present invention.
Figure 9:
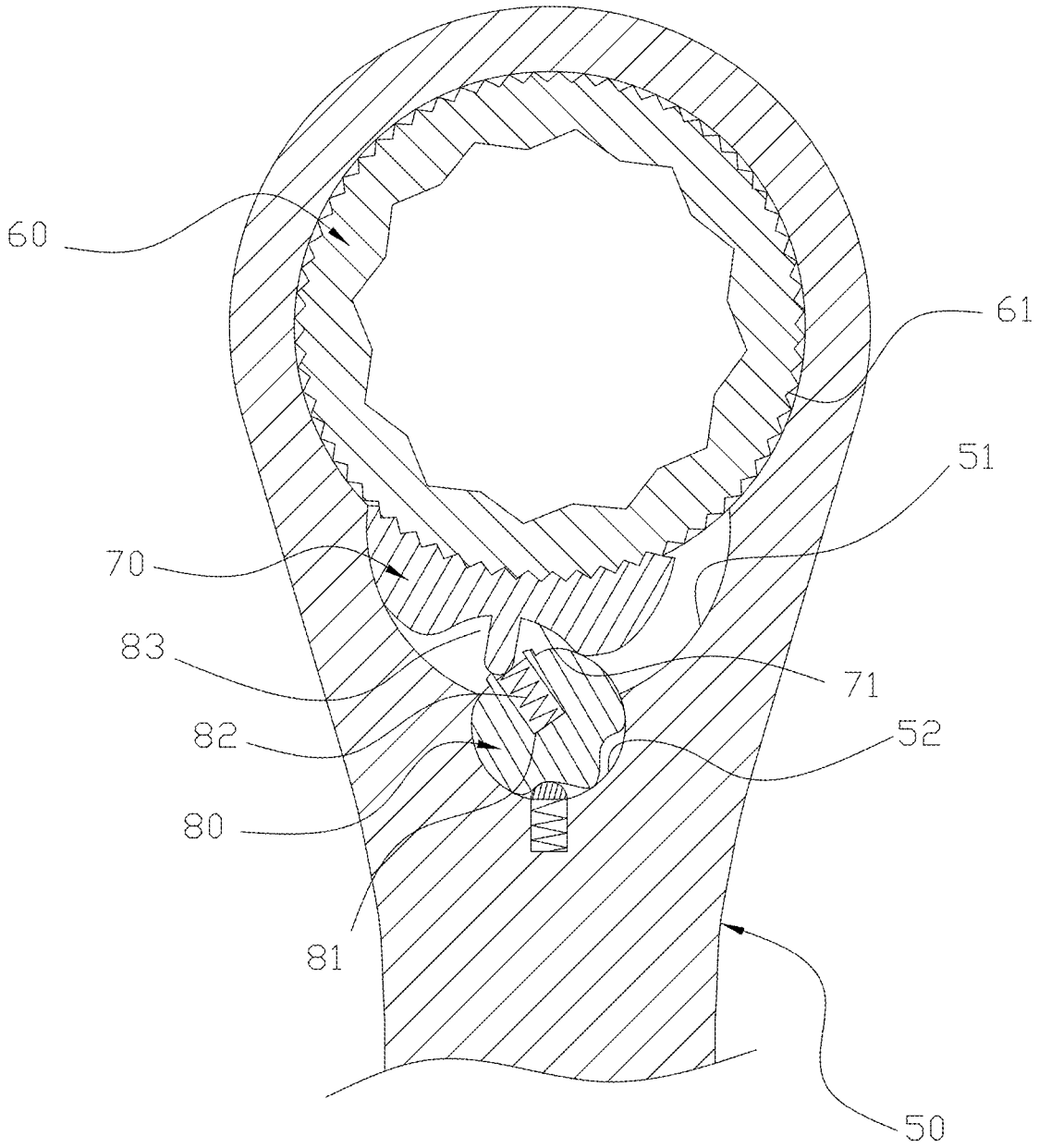
FIG. 9 PRIOR ART
FIG. 9 is a schematic drawing of a conventional wretch.

Next, when the control member 20 is pushed towards to the opposite direction, as shown in FIGS. 7 and 8, the braking toothed member 30 is pushed by the control member 20 and abuts against the arcuate groove 15, and the braking toothed member 30 is pushed counterclockwise by the link shaft 33 and the elastic member 34. When the wrench body 10 rotates counterclockwise, the direction of actuation of the wrench body 10 is identical with the action direction of the elastic member 34, such that the ratchet wheel 40 is able to push the braking toothed member 30 back along the direction of the elastic member 34, resulting in that the toothed portion 31 of the braking toothed member 30 cannot effectively engage with the annular toothed portion 41 of the ratchet wheel 40 and create an idle state. Conversely, when the wrench body 10 is rotated clockwise, the link shaft 33 and the of the braking toothed member 30 is pushed by the elastic member 34 in a direction opposite than the actuation direction of the wrench body 10, therefore the braking toothed member 30 cannot be pushed back and the arc tooth 31 does engage with the annular toothed portion 41 of the ratchet wheel 40, resulting in the ratchet wheel 40 is rotated and provides the twisting action of the screw locking unit.

According to the structure of the above specific embodiment, the following benefits are obtained: (1) The braking toothed member 30 utilizes the convex groove 32 to connect to the link shaft 33 via an connecting pin 321, and then the link shaft 33 is jacketed with the elastic member 34 and placed into the through hole 23 of the shaft rod 22 of the control member 20. As result, when the control member 20 is switched, the linking shaft 33 drives the braking toothed member 30 through the connecting pin 321, which enhances the smoothness of the movement of the braking toothed member 30. Therefore, the elastic member 34 can reliably telescope in the through hole 23 to avoid deformation or pop-up failure conditions, thereby providing stable operation and increasing structural engagement strength to improve its durability. (2) The braking toothed member 30 utilizes the link shaft 33 and the elastic member 34, the elastic member 34 and the link shaft 33 is directly limited in the through hole 23, and the link between the braking toothed member 30 and the control member 20 can be completed, which efficiently simplify the assembly of the wrench body 10 while reduces assembly time and labor costs structure and helps to improve the economic efficiency.

Although the present invention has been explained in relation to its preferred embodiment, it is to be understood that many other possible modifications and variations can be made without departing from the spirit and scope of invention as hereinafter claimed.

What is claimed is:

1. A wrench comprising:

a wrench body having a first operating portion and a second operating portion, the first operating portion having an assembling aperture and a control aperture, the assembling aperture and the control aperture connected by an arcuate groove;

a control member having a handle and a shaft rod, the shaft rod provided with a stepped through hole and disposed in the control aperture;

a braking toothed member disposed in the arcuate groove, an end of the braking toothed member facing the assembling aperture comprising a toothed portion and another end facing the control aperture forming a convex groove, the convex groove connected to a link shaft via a connecting pin, the link shaft jacketed by an elastic member and together disposed in the through hole; and a ratchet wheel disposed in the assembling aperture of the first operating portion, an annular toothed portion disposed on a periphery of the ratchet wheel and engaging with the toothed portion of the braking toothed member, the ratchet wheel further comprising an operating hole.

2. The reversing wrench as claimed in claim 1, wherein an end of the link shaft is provided with a rounded end, and the rounded end has a through aperture for accepting the connecting pin.

3. The reversing wrench as claimed in claim 1, wherein the assembling aperture of the first operating portion further comprises a securing groove, the ratchet wheel is further provided with a positioning groove, the positioning groove engages with a C-shaped retainer ring, and the C-shaped retainer ring is disposed in the securing groove to position the ratchet wheel in the assembling aperture.

4. The reversing wrench as claimed in claim 1, wherein the wrench body further comprises a limiting groove above the control aperture, for limiting the handle of the control member, and the limiting groove has an opening, and a first stopping portion and a second stopping portion at two sides of the opening.

* * * * *